United States Patent [19]

Stiff et al.

[11] Patent Number: 4,890,399

[45] Date of Patent: Jan. 2, 1990

[54] RIDER TYPE TRENCHING MACHINE

[75] Inventors: Rodney A. Stiff; Malcolm J. Baker; Graham G. Yates, all of Bundaberg, Australia

[73] Assignee: Austoft Industries Limited, Bundaberg, Australia

[21] Appl. No.: 68,566

[22] Filed: Jun. 30, 1987

[30] Foreign Application Priority Data

May 26, 1987 [AU] Australia ..... PI.2153

[51] Int. Cl.[4] ..... E02F 5/06

[52] U.S. Cl. ..... 37/86; 403/114

[58] Field of Search ..... 37/80 R, 83, 90, 129, 37/248, 86; 403/114

[56] References Cited

U.S. PATENT DOCUMENTS

| | | | |
|---|---|---|---|
| 2,733,524 | 2/1956 | Ingbritson | 37/248 |
| 3,209,473 | 10/1965 | Davis | 37/90 X |
| 3,439,436 | 4/1969 | McCleerey | 37/248 |
| 4,052,804 | 10/1977 | Stedman | 37/129 |
| 4,332,500 | 6/1982 | Smith, Jr. et al. | 403/114 |
| 4,475,604 | 10/1984 | Albertson et al. | 37/80 R X |

FOREIGN PATENT DOCUMENTS

| | | | |
|---|---|---|---|
| 402333 | 4/1970 | Australia . | |
| 567017 | 5/1987 | Australia . | |
| 1484647 | 3/1969 | Fed. Rep. of Germany | 37/80 R |
| 1100391 | 6/1984 | U.S.S.R. | 37/83 |
| 2088930 | 6/1982 | United Kingdom | 37/80 R |

OTHER PUBLICATIONS

John Deere tractor catalog #PC-4140, pp. 1 and 22 (1977).

*Primary Examiner*—Edgar S. Burr
*Assistant Examiner*—Moshe I. Cohen

[57] ABSTRACT

A trencher comprising a main frame. The main frame includes a pair of longitudinal, relatively narrow frame members spaced a distance apart and have a forward and rearward end. A first liquid carrying tank is mounted adjacent the rearward end of the trencher and extends between the frame members. The tank is operable to bear a significant structural load and to act as a cross member for the frame.

11 Claims, 5 Drawing Sheets

RIDER TYPE TRENCHING MACHINE

INTRODUCTION

This invention relates to trenching machine or trencher and, more particularly, to a trenching machine on which the operator may ride and which is self-propelled.

BACKGROUND OF THE INVENTION

Trenchers are machines used for digging trenches into which pipe, cable and the like may be laid and then covered. The trench cut by the trencher is as cleanly formed as possible to reduce unnecessary damage to the earth surface since such trenches are commonly make to lay underground wiring or telephone cables in residential areas.

Such trenchers commonly have the trenching head or cutting tool mounted on the rear of the vehicle with the filling blade mounted on the forward end. The operator faces forwardly and while the machine is moving in the forward direction, the trenching head is lowered and the trench is dug. After the trench is completed or simultaneously therewith, the cable or pipe is laid in the trench. Thereafter, the filling blade on the forward end of the trencher is used to fill the trench with the previously removed earth.

Present trenchers suffer many disadvantages. One problem is the operators position. Because the operator faces forwardly, he is continually looking rearwardly over his shoulder to determine the operating characteristics of the trenching head. When a trench is being dug, however, there is considerable shock transferred to the vehicle and thereafter transferred to the operator. When the operator is in a position with his head sidewise to observe the trenching unit, there is additional strain placed on his back and the additional shock because of such an operating position results in frequent spinal injuries to such operators.

A further problem with existinq trenchers is that relating to the operating platform and controls. In present trenchers, foot operated controls for at least some of the trencher functions are present. The presence of such foot operated controls on the operating platform creates tripping opportunities and a cluttered operating environment. More importantly, however, the chance of a back injury occurring is increased. This is so because the operator may place additional strain on his back because of the concurrent use of a foot control when his sight extends rearwardly in observing the trenching head. Some trenchers have rotatable operating consoles. When the operating console is rotated, the presence of foot operated controls or other obstructions on the operating platform of the trencher offer the potential for inconvenience and possible injury to the operator when the operating console is being rotated.

Yet a further problem with existing trenchers is that most are mechanically operated or utilize a combination of mechanical and hydraulic components to power the vehicle and to operate the trenching unit attached to the vehicle. Mechanical components in a trencher, while being commonly used and easily available are not the most desirable components in a machine which is continually subject to shock and impact loading. This is so since, again, the impact loads are transmitted directly to the frame of the vehicle and, thereafter, are transmitted to the operator. Such loads are absorbed only minimally in the mechanical components used for the power train and trenching unit. A related problem is that with a mechanical power train using forward and rearward differentials, the position of the drive shaft from the prime mover to the rear differential results in an operator straddling the drive shaft. Again, therefore, the operating platform is obtrusive and inconvenient for the operator.

Yet a further problem relates to the frame of existing trenchers. Usually, such trenchers have a longitudinal frame with series of cross members located transversely between the longitudinal frame members. The hydraulic fluid and fuel oil tanks are mounted in a position attempted to be non-obtrusive but they serve only the function of carrying fuel or hydraulic fluid. The use of the tanks strictly for a single function increases the weight of the trencher and the cost unnecessarily.

Yet a further problem with existing trenchers has been the serviceability of components which must be inspected and serviced frequently. Such components are generally located between the frame members which makes access difficult.

Yet a further problem with existing trenchers again relates to the operators use of the machine. Such problems as the line of sight which extends from the operating position to the ends of the filling blade and, as well, which should extend to the entire trenching unit have never been satisfactorily resolved.

Yet a further problem with existing trenchers lies in the use of their axle assemblies and filling blades. In order to obtain a properly floating filling blade, it is advantageous to have a support arm for the blade as long and as nearly horizontal as possible. Such a design allows a blade to more smoothly transfer loading forces because the moment created by such forces on the filling blade will be minimized. Present trenchers use four wheel drive designs with a drive shaft connected between forward and rearward located differentials. Such differentials are large and decrease ground clearance which is undesirable. More importantly, the presence of a differential and drive shaft in the forward and lower area of the trencher will prohibit the support arm extending from the filling blade from proceeding below the differential because of the aforementioned ground clearance objective. Thus, more complex and costly designs must be used to obtain a satisfactorily floating filling blade.

Yet a further problem with existing trenchers relates to the use of the trenching unit itself. Mechanically driven trenching units are used with drive shafts and drive gears. Because such trenching units are pivotable from the transport to the operating position only about the axis of the drive gear, the trenching unit position is necessarily a compromise between the two positions. In addition, the transverse position of the trenching unit with a mechanical drive can only be changed with considerable difficulty.

Yet a further problem relating to present trenching units is that impacts caused by hard rocks, tree roots and the like contacting the teeth attached to the digging chain are transmitted to the trenching unit itself and the power source for the trenching unit. This is a particular problem when hydraulic motors are used as the prime movers for the trenching unit as such impacts cause pressure spikes which can damage the hydraulic motor and driving pump

SUMMARY OF THE INVENTION

According to one aspect of the invention, there is disclosed a vehicle comprising a pair of longitudinal, relatively narrow frame members spaced a distance apart with a forward and rearward end and a first liquid carrying tank mounted adjacent said rearward end and extending between said pair of longitudinal frame members, said tank being operable to bear a significant load and being adapted to act as a structural cross member between said frame members.

According to a further aspect of the invention, there is disclosed an operating console for a trencher comprising an operators chair mounted above an operating platform, said operators chair being connected to a operators console by connection means, said connection means being located substantially above the platform of said trencher and adjacent the level of said operators chair, said connection means being located on one side of said operators chair and said operators console, said operating console being mounted for partial rotation between the forward and rearward ends of said trencher.

According to a further aspect of the invention, there is disclosed a trenching unit comprising a mounting bracket, a trenching head connected to said mounting bracket, said trenching head including a hydraulic motor, said mounting bracket and said trenching head being movable between a pluralitY of operating positions on the rear of a trencher.

According to a further aspect of the invention, there is disclosed a trenching unit comprising a frame, a mounting bracket connected to said frame, a trenching head connected to said mounting bracket, hydraulic cylinder means mounted between said mounting bracket and said trenching head, said trenching head including hydraulic motor means and drive sprocket means, said trenching head being rotatable about a pivotable axis removed from the axis of said drive sprocket.

According to yet a further aspect of the invention, there is disclosed a drive assembly for a trenching unit comprising a drive motor, a digging chain mounted on a drive sprocket, a gear train between said drive sprocket and said drive motor and a flywheel connected in said gear train.

BRIEF DESCRIPTION OF THE SEVERAL VIEWS OF THE DRAWINGS

The invention will now be described, by way of example only, by the use of drawings in which.

DESCRIPTION OF SPECIFIC EMBODIMENT

Figure 2:
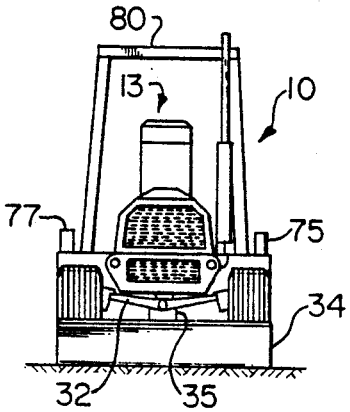
FIG. 2 is a front view of the trenching machine of FIG. 1.
Figure 3:
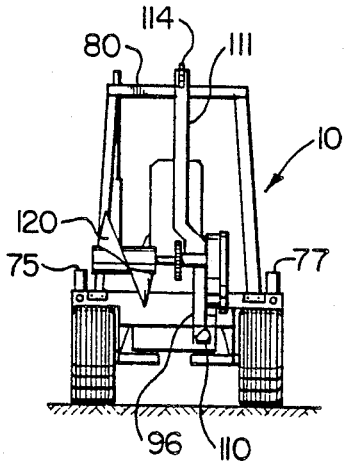
FIG. 3 is a rear view of the trenching machine of FIGS. 1 and 2.
Figure 5:
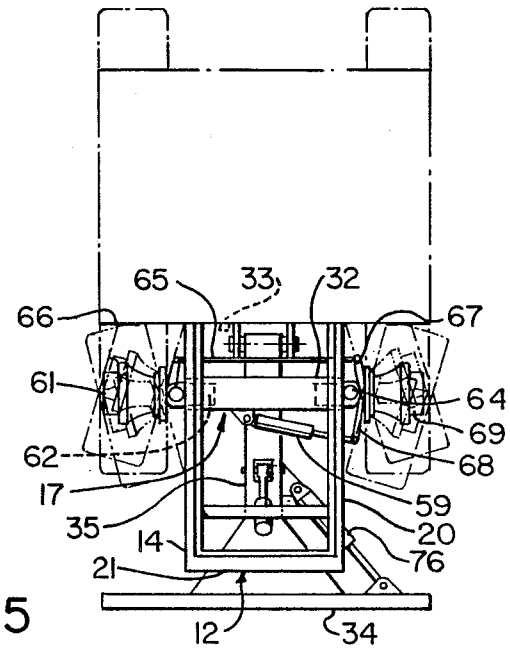
FIG. 5 is a partial sectional view taken along the lines V—V of FIG. 6.

Referring now to the drawings, a trenching machine is shown generally at 10 in FIG. 2. It comprises four main units, the trenching head or unit generally shown at 11, the longitudinal main frame generally shown at 12 (FIG. 5), the operating console generally shown at 13 and the combination front axle and filling blade assemblies generally shown at 17 (FIG. 5).

Figure 7:
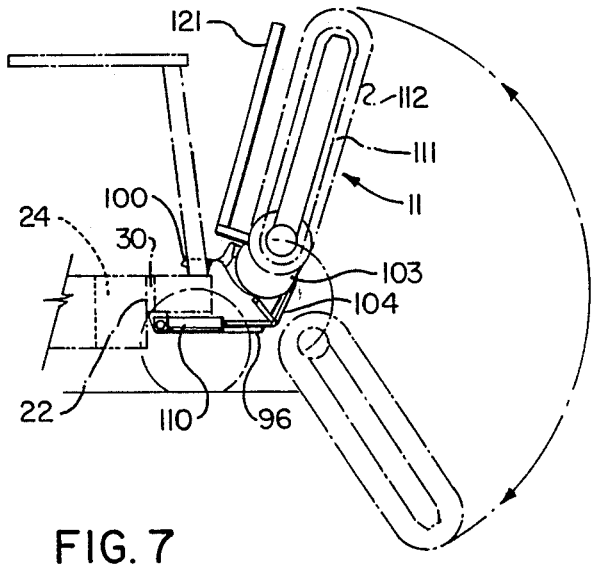
FIG. 7 is a diagrammatic side view of the trenching unit.
Figure 8:
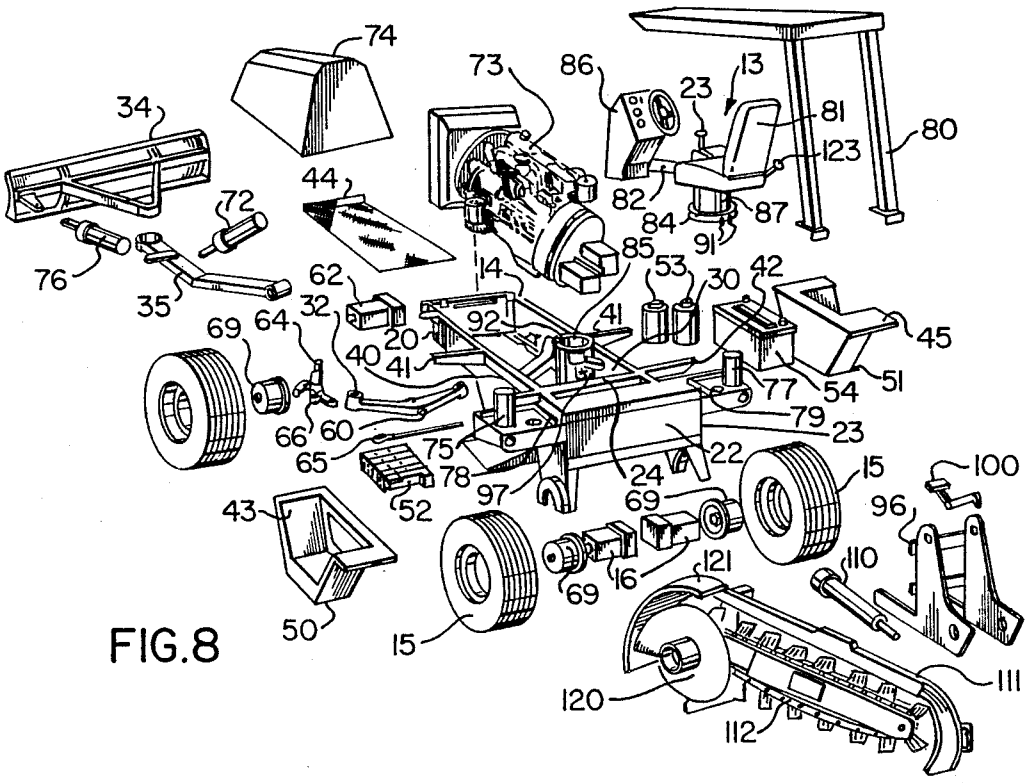
FIG. 8 is an exploded isometric view of the trencher according to the present invention.

The longitudinal main frame 12 consists of a pair of relatively narrow frame members 14,20 spaced a distance apart depending upon the size of the particular trenching machine 10. The longitudinal frame members 14,20 have a forward end 21 which is the forward end of the machine 10 and a rearward end 22 (FIG. 7).

At the rearward end 22 of the longitudinal main frame 12, a fuel tank 23 holds the fuel for the vehicle 10 and acts as a structural cross member for the longitudinal frame members 14,20. A second tank, namely the hydraulic oil tank 24 also extends between the longitudinal frame members 14, 20 and is connected thereto. The hydraulic oil tank 24 is mounted forwardly of the fuel tank 23 and similarly acts as a structural cross member and bears a significant portion of the load on the longitudinal main frame 12. The rear wheels 15 of the trenching machine 10 and their associated hydraulic motors 16 are mounted in the longitudinal frame members 14,20 adjacent the fuel and hydraulic oil tanks 23,24, respectively. The fuel and hydraulic oil tanks 23,24, respectively, also act to support the operating console 13 as will be explained hereafter.

A recess 30 between the fuel tank 23 and the hydraulic oil tank 24 is provided to act as an insulator to prevent the transfer of heat from the hydraulic oil in the tank 24 to the fuel in the fuel tank 23.

Two further cross-members are provided between the longitudinal frame members 14,20 in the forward end of the main frame 12. The forwardmost cross-member 31 acts as a first mounting location for attachment of the axle 32 and its associated elements as will be described in greater detail hereafter. The cross-member 33 (FIG. 5) located rearwardly of the forwardmost cross-member 31 acts as a second mounting location for the support arm 35 of the filling blade 34, the support arm 35 extending to the filling blade 34 below the axle 32, the filling blade 34 being positioned at the forward end of the trenching machine 10 as will also be explained in greater detail hereafter.

Two openings 40, only one of which is shown, are positioned in the longitudinal frame members 14,20. Each opening 40 is located centrally between the forward and rearward ends of the frame members 14,20. Each opening 40 allows access to the components between the longitudinal frame members 14,20.

A pair of platform support brackets 41,42, extend outwardly from the longitudinal frame members 14,20 and act to support the metal sheets 43,44,45, respectively, which form the flat and unobstructed operators platform 46. Each of the metal sheets 43,45 act to support a cover 50,51 within which are housed the most frequentlY serviced components of the trenching machine 10, namely the hydraulic valve assemblY generally shown at 52 on the leftward side of the machine 10 and the oil filters 53 and battery 54 on the rightward side of the machine 10. The covers 50,51 are removable together with the metal sheets 43,45 so as to allow ready access to the components therein which are located outside the longitudinal frame members 14,20.

The front axle 32 is, as previously noted, attached to the forwardmost cross member 31. A pin 60 is inserted though the axle 32 and this pin 60 also extends through the cross member 31. A steerable wheel assembly 61 is mounted to each side of the axle 32 and a respective hydraulic motor 62 is mounted to each of the steerable wheel assemblies 61. The steerable wheel assemblies 61 each include a king pin assembly 64 and a mount plate 66 connected to the king pin assembly 64. Each hydraulic motor 62 is connected to a respective mount plate 66. The king pin assembly 64 further includes a tie rod arm 67 and a steering arm 68. A reduction gear drive 69 is mounted to each king pin assembly 64. A tie rod 65 extends between the tie rod arms 67 on each king pin assembly 64.

A steering cylinder 59 is connected between the steering arm 68 of the king pin assembly 64 and the frame 12 of the trencher 10. A support arm 35 is pivotally mounted to a bracket 36 of the cross member 33. The support arm 35 extends between the mounting bracket 36 and the filling blade 34 below the axle 32. A hydraulic cylinder 72 extends between the frame 12 and the support arm 35 and is used to raise or lower the filling blade 34. A second hydraulic cylinder 76 is connected between the filling blade 34 and support arm 35 as best seen in FIG. 5. This cylinder 76 is used to change the angle of the filling blade 34 as may be desired.

The engine 73 of the trencher 10 is mounted on the longitudinal frame members 14,20 (FIG. 7) as illustrated. An engine cover 74 is mounted to be positioned over the engine 73 and is hingedly mounted to the forward end 21 of the trencher 10 so as to be easily removed and expose the engine 73.

The canopy or ROPS structure 80 is mounted on the frame members 14,20 adjacent the fuel tank 23 at the rearward end of the main frame 12. It extends over the operator and also acts to provide protection from the elements as well as protection in the event of a rollover. Located outboards of the ROPS structure 80 and on the operating platform 46 are the filler heads 75,77 for the fuel and the hydraulic oil, respectively. A small fence 78,79 surrounds each filler head 75,77 so that spillage cannot contaminate the floor of the operating platform 46.

The operating console 13 is supported by the hydraulic oil tank 24. The operating console 13 comprises an operators chair 81 rotatably mounted on the top of the hydraulic oil tank 24 and a connection duct 82 (FIG. 4) smoothly extending between the operators chair 81 and the operators console 86. The operators console 86 is located forwardly of the operators chair 81. It houses several operating controls and instruments for the trencher 10. The necessary electrical and hydraulic cables extend through the opening 85 in the platform 46 up the cylinder 87 on which the operators chair 81 is mounted and through the connection duct 82 to the operators console 86. The connection duct 82 is located substantially above the level of the operating platform 46 and on one side of the operators chair 81 and the operators console 86.

A further bank of operators controls 83 is mounted on the top of the connection duct 82 adjacent the operators chair 81 and between the operators console 86 and the operators chair 81 so as to fall readily to hand. The controls 83 on the connection duct 82 comprise the primary controls, namely vehicle direction, vehicle speed and the speed of the chain on the trenching head 11. There are no foot operated controls utilized on the trencher 10.

A flat plate 84 is connected to the bottom of the operators chair 81 about the circumference of the cylinder 87 which supports the operators chair 81. Twin stops 91 are mounted on flat plate 84. They act to contact a protuberance 97 connected to the frame 12. They allow the plate 84 to rotate a maximum of 125 degrees on each side of the longitudinal axis of the trencher 10. A plurality of recesses 92 in the flat plate 84 which allow a keeper pin 93 (not shown) to be inserted at the desired operating location. The operators chair 81 may be located at the 90, 105 and 125 degree positions from the centre position as desired.

Figure 4:
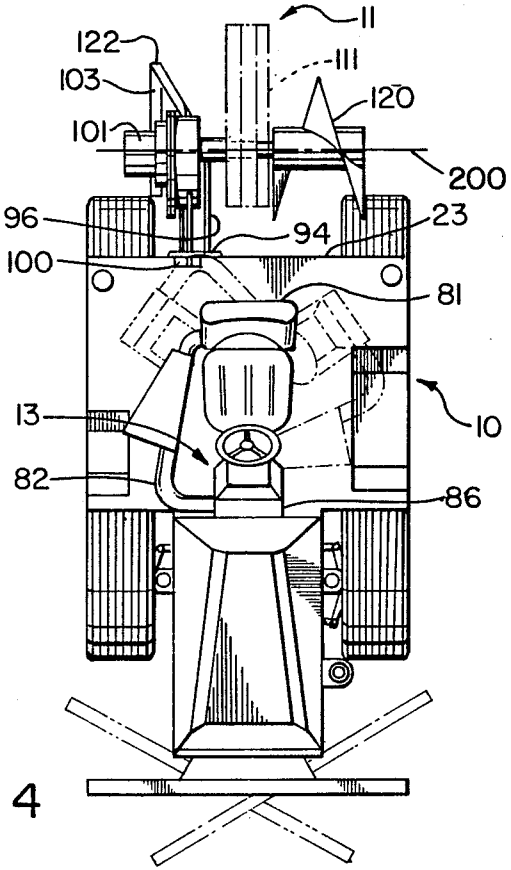
FIG. 4 is a plan view of the trenching machine according to the previous figures.
Figure 6:
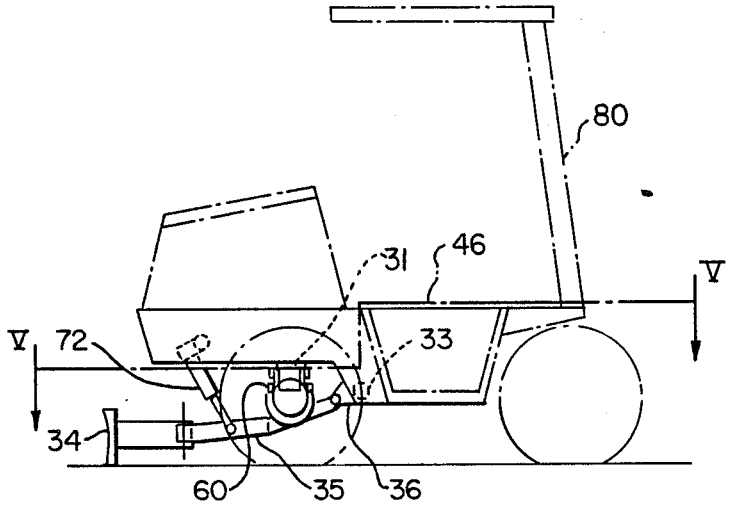
FIG. 6 is a side view of the trencher with particular reference to the front axle and filling blade assemblies.

With particular reference to FIG. 4, the trenching unit 11 is mounted on the rear of the fuel tank 23 located at the rear of the trencher 10. It comprises a mounting bracket 96 connected to a complementry bracket 94 mounted on the fuel tank 23. The mounting bracket 96 may be moved laterally on complementary bracket 94 so that the trenching unit can assume a plurality of operating positions, whichever is most desirable for the particular application. A safety pawl 100 is provided which is operable by the action of the operators foot. It retains the trenching unit 11 in its raised position. A hydraulic motor 101 and drive assembly generally shown at 102 are mounted in the trenching unit head 103. The drive assembly 102 (FIG. 9) comprises an input shaft 105 which drives drive gear 106. A relatively heavy flywheel 107 is mounted to the drive gear 106 and rotates therewith. The drive gear 106 powers drive gear 107 which, in turn, drives the drive sprocket 113 to which the chain 112 is connected. The drive assembly 102 reduces the output speed of the hydraulic motor 101 to the desired speed for the chain 112. The trenching unit head 103 is pivotally connected to mounting bracket 96 for rotation about the pivotal connection 104 (FIG. 7) so that the trenching unit 11 may be raised or lowered in travelling to or from the operating location for the trencher 10. A hydraulic cylinder 110 is connected between the mounting bracket 96 and the frame 12 of the trencher 10 on the side of the pivotal connection 104 removed from the mounting bracket 96. Thus, the cylinder 110 raises and lowers the trenching unit 11. The pivotal connection 104 (FIG. 7) defines the axis of rotation of the trenching unit. In particular, the axis of rotation of this unit is perpendicular to the plane of FIG. 7 and passes through the pivotal connection.

Figure 1:
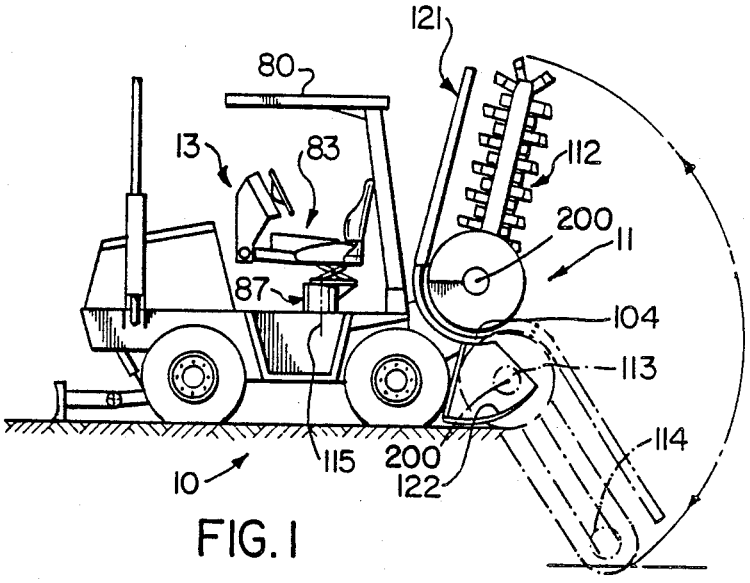
FIG. 1 is a side view of the trenching machine according to the invention.
Figure 9:
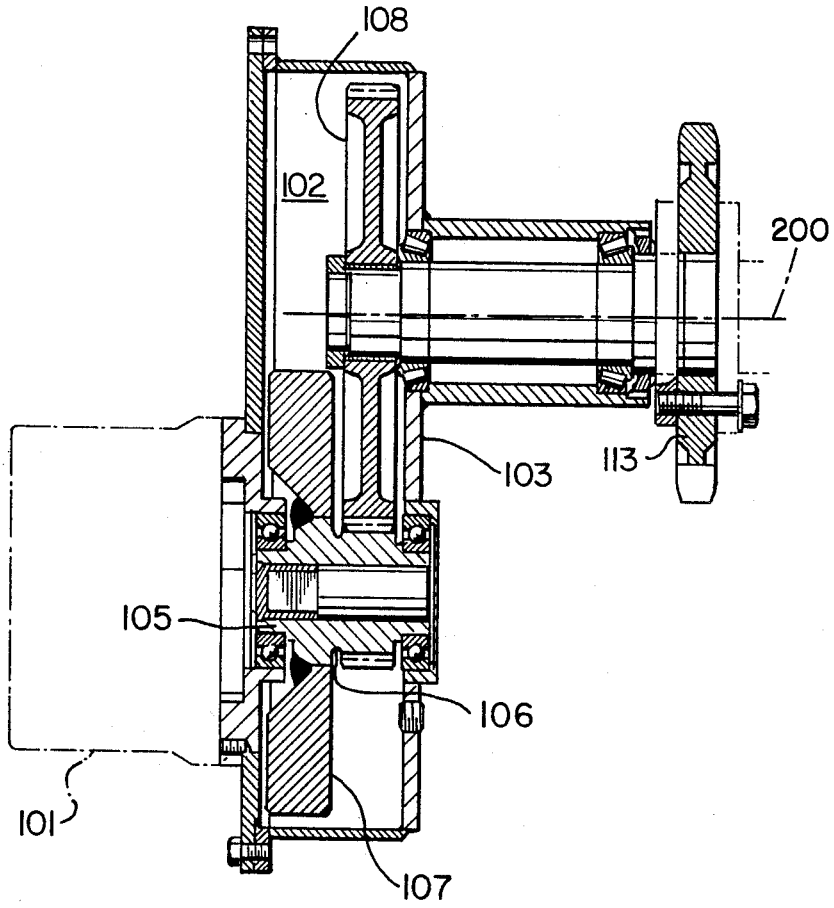
FIG. 9 is a partial diagrammatic sectional view of the gear train.

The digging head 111 comprises the aforementioned chain 112 connected to the drive gear 113 which extends from the trenching unit head 103. The chain 112 moves between the drive sprocket 113 and an idler gear 114. An auger 120 is mounted on the same axis 200 as the drive sprocket 113 to remove the earth which is brought to the surface by the chain 112 to one side of the machine. Axis 200 is shown in FIGS. 1, 4 and 9. As can be seen in these figures, this axis of rotation is spaced from the axis of rotation of the trenching unit defined by pivotal connection 104. A chain guard 121 (FIG. 7) extends from the trenching unit head 103 and surrounds the top of the chain 112 for safety. A support arm 122 is also attached to the trenching unit head 103 and acts to support the trencher 10 as the digging operation is underway and to transfer the digging shocks to some degree from the trenching unit 11 to the ground rather than to the trencher 10.

OPERATION

In operation, the operator will commence the operation of the trencher 10 by positioning the trencher 10 at the desired operating location. The operators controls 83 include an engine r.p.m. lever (not shown), a direction lever (not shown) for the trencher 10 and a lever (not shown) used to commence the movement of the chain 112.

The operator may wish to assume a rearward operating position and, in order to do so, he will grasp lever 123 adjacent the operators chair 81 and pull it upwardly to allow keeper pin 93 to become removed from the centre recess and thereby allow the operating console 13 to be rotated in its entirety around the axis 115 of the cylinder 87. The operator may then select the desired operating location whereby the keeper pin 93 automatically reenters the appropriate recess. The operator will then commence the operation of the chain 112 with the use of the appropriate control lever in the operators controls 83.

The operator will initially lift the trenching unit 11 by the appropriate control lever on the operators console 86. The safety pawl 100 will be manually disengaged from the trenching unit 11 which will then be lowered from its raised to its lowered position by contracting the hydraulic cylinder 110.

The pressure of the chain 112 on the earth may be controlled by the use of the appropriate control lever on the operators console 86. Because the support arm 122 will assume a position on top of the earth, a good amount of force will be transferred by the chain 112 through the support arm 122 directly to the ground. The operator, while operating the trenching unit 11, will also be moving the trencher 10 forwardly while digging. This is accomplished by moving the speed control lever in the operators controls 83. A high and low speed range is also provided in the operators controls 83. The use of the high speed range is for movement of the trencher 10 between operating locations. The use of the low speed range is used when digging and operation of the trencher unit head 11.

While in the digging mode, any impacts caused by hard rocks, tree roots and the like are smoothed and absorbed by the use of flywheel 107 connected to drive gear 106. Thus, the problem of pressure spikes which can damage the hydraulic motor 101 is alleviated to a great extent.

Following completion of the trench digging, the operator will reverse the position of the trencher 10 and put the operating console 13 in the straight ahead location. He will raise the trenching unit 11 and manually secure it by operating the safety pawl 100. The filling blade 34 will be lowered on the support arm 35 by the use of hydraulic cylinder 72 and the blade skew angle will be adjusted by extending or retracting hydraulic cylinder 76. The earth removed by the chain 112 and positioned to one side of the trench by the auger 120 will then be pushed back into the trench following the placement of the cable or pipe.

Many modifications to the invention may readily occur to those skilled in the art and while a specific embodiment of the invention has been described, such embodiment should be taken as illustrative only and not as limiting the scope of the invention as construed in accordance with the accompanying claims.

What is claimed is:

1. A trenching unit comprising a frame, a mounting bracket connected to said frame, a trenching head pivotally connected to said mounting bracket, hydraulic cylinder means mounted between said mounting bracket and said trenching head for raising and lowering the trenching head about a first axis of rotation, said trenching head including hydraulic motor means, drive sprocket means having a second axis of rotation for driving a digging chain, and an auger rotatable about said second axis of rotation, said first and second axes of rotation being spaced from one another, said auger being raised and lowered about said first axis of rotation as part of said trenching head.

2. A trenching unit as in claim 1 wherein said mounting bracket is moveable between a plurality of positions with said trenchable head.

3. A trenching unit comprising a mounting bracket, a trenching head connected to said mounting bracket, said trenching head being rotatable about a pivot axis and including (a) a hydraulic drive motor (b) a drive sprocket for driving a digging chain, said drive sprocket having an axis of rotation, and (c) an auger rotatable about said axis of rotation, said axis of rotation being spaced from the pivot axis, said mounting bracket and said trenching head being movable between a plurality of operating positions transversely spaced across the rear of a trencher.

4. A trenching unit as in claim 3 and further comprising a digging chain mounted on said drive sprocket, a gear train between said drive sprocket and said drive motor and a flywheel connected in said gear train.

5. A trenching unit as in claim 4 wherein said gear train comprises a first drive gear coupled to said hydraulic motor and a second drive gear coupled to said first drive gear, said drive sprocket being driven by said second drive gear and said flywheel being connected to said first drive gear.

6. A trencher comprising:

(a) a frame, (b) first and second mounting means connected to said frame below said frame, said second mounting means being located rearwardly of said first mounting means, a filling blade positioned forwardly of said trencher and said first and second mounting means, an axle pivotably connected to said first mounting means, a support arm for said filling blade extending between said second mounting means and said filling blade and below said axle, a steerable wheel assembly mounted to each side of said axle and at least one hydraulic motor means mounted to each of said steerable wheel assemblies, and (c) a mounting bracket connected to said frame, a trenching head pivotally connected to said mounting bracket, hydraulic cylinder means mounted between said mounting bracket and said trenching head for raising and lowering the trenching head about a first axis of rotation, said trenching head including hydraulic motor means, drive sprocket means having a second axis of rotation for driving a digging chain, and an auger rotatable about said second axis of rotation, said first and second axes of rotation being spaced from one another, said auger being raised and lowered about said first axis of rotation as part of said trenching head.

7. A trencher as in claim 6 wherein each of said steerable wheel assemblies comprise a king pin assembly and a mount plate connected to said king pin assembly, said hydraulic motor being connected to said mount plate.

8. A trencher as in claim 7 wherein said king pin assembly further comprises tie rod and steering arm means.

9. A trencher as in claim 8 and further comprising reduction gear drive means mounted to said king pin assembly.

10. A trencher as in claim 9 and further comprising a tie rod extending between said king pin assemblies on each of said steerable wheel assemblies.

11. A trencher as in claim 10 and further comprising a steering cylinder connected between said steering arm means and said frame.

* * * * *